US011378080B2

(12) United States Patent
Iyanagi

(10) Patent No.: US 11,378,080 B2
(45) Date of Patent: Jul. 5, 2022

(54) COMPRESSOR

(71) Applicant: Mitsubishi Electric Corporation, Tokyo (JP)

(72) Inventor: Tomohiro Iyanagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 139 days.

(21) Appl. No.: 16/970,181

(22) PCT Filed: Mar. 14, 2018

(86) PCT No.: PCT/JP2018/009993
§ 371 (c)(1),
(2) Date: Aug. 14, 2020

(87) PCT Pub. No.: WO2019/176014
PCT Pub. Date: Sep. 19, 2019

(65) Prior Publication Data

US 2021/0102539 A1 Apr. 8, 2021

(51) Int. Cl.
*F04C 29/02* (2006.01)
*F04C 23/00* (2006.01)
(Continued)

(52) U.S. Cl.
CPC ..... *F04C 29/026* (2013.01); *F04C 23/008* (2013.01); *F04C 29/0085* (2013.01);
(Continued)

(58) Field of Classification Search
CPC .... F04C 34/008; F04C 29/0085; F04C 29/06; F25B 31/026; F25B 31/004; F25B 2400/23
See application file for complete search history.

(56) References Cited

U.S. PATENT DOCUMENTS 6,623,253 B1 * 9/2003 Onoda ..... F04B 35/04 310/59
2012/0294733 A1 11/2012 Yamada et al.
(Continued)

FOREIGN PATENT DOCUMENTS

CN 102713288 A 10/2012
CN 203879745 U 10/2014
(Continued)

OTHER PUBLICATIONS

Office Action dated Oct. 8, 2021, issued in corresponding CN Patent Application No. 201880090961.2 (and English Machine Translation).
(Continued)

*Primary Examiner* — Patrick Hamo
(74) *Attorney, Agent, or Firm* — Posz Law Group, PLC

(57) ABSTRACT

In a compressor, a sufficient insulation distance is ensured between a motor and a compression mechanism, and the amount of lubricating oil that flows out with refrigerant discharged from the compressor is reduced, while the volume of the compressor is reduced. The compressor includes: a compression mechanism that compresses refrigerant; a motor unit above the compression mechanism to drive the compression mechanism; a shell that houses the compression mechanism and the motor unit; and a lower insulating member between the compression mechanism and the motor unit. The motor unit includes a stator fixed to the shell, and a rotor spaced from an inner circumferential surface of the stator by a predetermined gap. The rotor has a rotor passage that causes spaces above and below the motor unit to communicate with each other, and the lower insulating member is in a region outward of the inner circumferential surface of the stator.

17 Claims, 6 Drawing Sheets

(51) Int. Cl.

| | |
|---|---|
| ***F04C 29/00*** | (2006.01) |
| ***F25B 31/00*** | (2006.01) |
| ***F25B 31/02*** | (2006.01) |

(52) U.S. Cl.
CPC ..... *F25B 31/004* (2013.01); *F25B 31/026* (2013.01); *F25B 2400/23* (2013.01)

(56) References Cited

U.S. PATENT DOCUMENTS

| | | | | |
|---|---|---|---|---|
| 2016/0040672 | A1* | 2/2016 | Lee | F04C 29/026 417/410.5 |
| 2018/0328364 | A1* | 11/2018 | Kim | B01D 50/20 |
| 2022/0034557 | A1* | 2/2022 | Choi | F01C 21/007 |

FOREIGN PATENT DOCUMENTS

| | | | |
|---|---|---|---|
| CN | 204458348 | U | 7/2015 |
| JP | H08-261152 | A | 10/1996 |
| JP | H09-151886 | A | 6/1997 |
| JP | 2001-263239 | A | 9/2001 |
| JP | 2008-031913 | A | 2/2008 |
| JP | 2009-191761 | A | 8/2009 |
| JP | 2013-137004 | A | 7/2013 |
| JP | 2016-109045 | A | 6/2016 |

OTHER PUBLICATIONS

International Search Report of the International Searching Authority dated Jun. 19, 2018 for the corresponding International application No. PCT/JP2018/009993 (and English translation).
Office Action dated Apr. 12, 2022 issued in corresponding CN patent application No. 201880090961.2 (English translation).

* cited by examiner

COMPRESSOR

CROSS REFERENCE TO RELATED APPLICATION

This application is a U.S. national stage application of International Application PCT/JP2018/009993 filed on Mar. 14, 2018, the contents of which are incorporated herein by reference.

TECHNICAL FIELD

The present disclosure relates to a compressor, and in particular, relates to a structure for reducing the volume of space in a shell.

BACKGROUND ART

In existing apparatuses each including a refrigeration cycle circuit, such as air-conditioning apparatuses, a compressor, a condenser, a pressure reducing device, and an evaporator are connected by pipes, and refrigerant is circulated to exchange heat with air. As refrigerant for use in the air-conditioning apparatuses, R32 and R410A are primarily adopted, and have high global warming potentials (GWPs), that is, a GWP value of 675 and a GWP value of 2090, respectively. By contrast, some air-conditioning apparatuses use natural refrigerants. For example, R290 has a GWP value of 3, which is a low value, but it is highly flammable refrigerant.

In a refrigeration cycle circuit employing highly flammable refrigerant, it is necessary to reduce the amount of refrigerant provided in the circuit in order to prevent, even if the refrigerant leaks into a given space, the concentration of the refrigerant in the space from falling within a flammable range that is a concentration range of refrigerant that will burn. In order to do so, it is also necessary to reduce the volume of a compressor, which occupies a large volume in the refrigeration cycle circuit. For example, in a hermetic motor-driven compressor disclosed in Patent Literature 1, the distance between a compression mechanism and a motor is small, and as a result the volume of the hermetic motor-driven compressor is also small.

CITATION LIST

Patent Literature

Patent Literature 1: Japanese Unexamined Patent Application Publication No. 8-261152

SUMMARY OF INVENTION

Technical Problem

In the hermetic motor-driven compressor disclosed in Patent Literature 1, since the distance between the compression mechanism and the motor is small, an insulation distance between the compression mechanism and coils of the motor is also small. Thus, an insulating plate is provided between the coils of the motor and components of the compression mechanism. Inevitably, the insulating plate provided between the coils of the motor and the component of the compression mechanism hinders circulation of lubricating oil in the hermetic motor-driven compressor. Furthermore, since the space in a shell of the hermetic motor-driven compressor is small in volume, the distance from the compression mechanism to a discharge port through which the refrigerant flows out of the compressor is also small. In such a manner, because the distance from the compression mechanism to the discharge port is small, the lubricating oil does not easily separate from gas refrigerant containing the lubricating oil. Consequently, after flowing out of the hermetic motor-driven compressor, the lubricating oil is dispersed in a refrigeration cycle circuit.

The present disclosure is applied to solve the above problems, and relates to a compressor in which a sufficient insulation distance is ensured between a motor and a compression mechanism, and the amount of lubricating oil that flows out along with refrigerant discharged from the compressor is reduced, while the volume of the compressor is reduced.

Solution to Problem

A compressor according to an embodiment of the present disclosure includes: a compression mechanism that compresses refrigerant; a motor unit provided above the compression mechanism to drive the compression mechanism; a shell that houses the compression mechanism and the motor unit; and a lower insulating member provided between the compression mechanism and the motor unit. The motor unit includes a stator fixed to the shell, and a rotor spaced from an inner circumferential surface of the stator by a predetermined gap. The rotor has a rotor passage that causes spaces located above and below the motor unit to communicate with each other, and the lower insulating member is located in a region outward of the inner circumferential surface of the stator.

Advantageous Effects of Invention

According to the embodiment of the present disclosure, an appropriate insulation distance is ensured between the motor unit and the compression mechanism, and the lubricating oil is separated from the refrigerant in the compressor, while the volume of the compressor is reduced. It is therefore possible to reduce the amount of refrigerant enclosed in a refrigeration cycle circuit in which the compressor is located, and adopt highly flammable refrigerant. Thus, a refrigeration cycle apparatus having a low GWP can be achieved.

DESCRIPTION OF EMBODIMENTS

Embodiment 1

Figure 1:
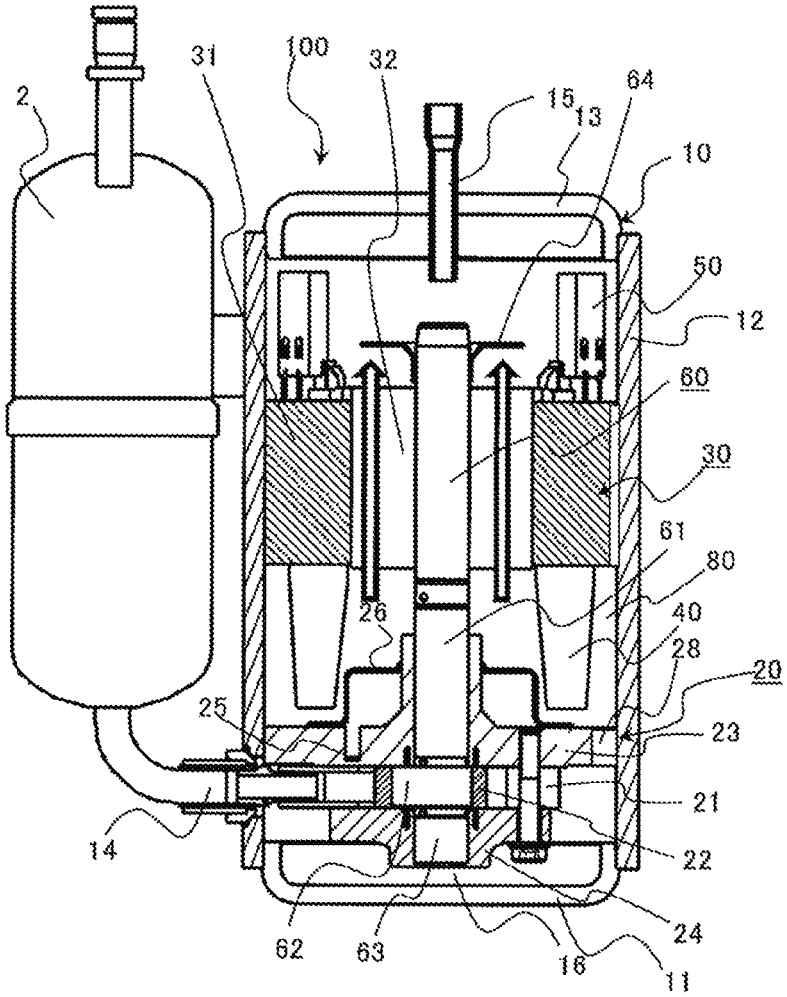
FIG. 1 is a schematic diagram illustrating a section of a compressor according to Embodiment 1.

FIG. 1 is a schematic diagram illustrating a section of a compressor 100 according to Embodiment 1. The compressor 100 compresses refrigerant that is circulated in a refrigeration cycle circuit included in an apparatus such as an air-conditioning apparatus. As the refrigerant, a flammable refrigerant or a slightly flammable refrigerant can be used. In the refrigeration cycle circuit including the compressor 100 according to Embodiment 1, as the refrigerant, any of R290, R600a, R32, R454B, R1234yf, and R1234ze is used. R290 and R600a are flammable refrigerants and classified as A3, and R32, R454B, R1234yf, and R1234ze are slightly flammable refrigerants and classified as A2L. The compressor 100 includes a shell 10 as an outer shell, and has a suction port 14 located in lower part of the shell 10 and a discharge port 15 located in upper part of the shell 10. In the compressor 100, the refrigerant that circulates in the refrigeration cycle circuit flows into the compressor 100 through the suction port 14, and is compressed by a compression mechanism 20. The compressed refrigerant is discharged from the shell 10 to the refrigeration cycle circuit through the discharge port 15. The suction port 14 is connected with an accumulator 2. The refrigerant that circulates in the refrigeration cycle circuit is separated into gas refrigerant and liquid refrigerant in the accumulator 2 and flows into the compressor 100.

In the shell 10, the compression mechanism 20 and a motor unit 30 are provided. The refrigerant sucked through the suction port 14 is compressed by the compression mechanism 20. In the shell 10, the compressed refrigerant is discharged from the compression mechanism 20. Then, in the shell 10, the discharged refrigerant passes through a region in which the motor unit 30 is located, and is discharged to the refrigeration cycle circuit through the discharge port 15 provided in the upper part of the shell 10.

(Compression Mechanism 20)

In Embodiment 1, the compression mechanism 20 is a rotary compression mechanism 20 including a cylinder 21, a rolling piston 22, an upper bearing 23, a lower bearing 24, and a vane (not illustrated). However, the compression mechanism 20 may be another type compression mechanism, such as a scroll type compression mechanism or a reciprocating type compression mechanism.

In the compression mechanism 20, the cylinder 21 and the rolling piston 22 are provided between a lower surface of the upper bearing 23 and an upper surface of the lower bearing 24. The rolling piston 22 is provided in an internal space of the cylinder 21, and is located on an outer circumferential side of an eccentric portion 62 of a main shaft 60 coupled to the motor unit 30. The rolling piston 22 is rotated by the main shaft 60 in the internal space of the cylinder 7, and thus compresses together with the vane, the refrigerant. The compressed refrigerant is discharged through a discharge opening portion 25 in the upper bearing 23 located above the cylinder 21.

At the discharge opening portion 25, a discharge valve is provided. When a pressure in the cylinder 21 is higher than that in the shell 10, the discharge valve is pressed upwards, whereby the refrigerant is discharged from the cylinder 21. When the pressure in the cylinder 21 is lower than that in the shell 10, the discharge opening portion 25 is closed by the discharge valve.

The upper bearing 23 and the lower bearing 24 serve as bearings for the main shaft 60, and support along with a rotor 32, the main shaft 60 being rotated. The upper bearing 23 and the lower bearing 24 have respective cylindrical portions over which the main shaft 60 is slidable. In the following, the cylindrical portions may also be each referred to as a main shaft bearing.

Figure 2:
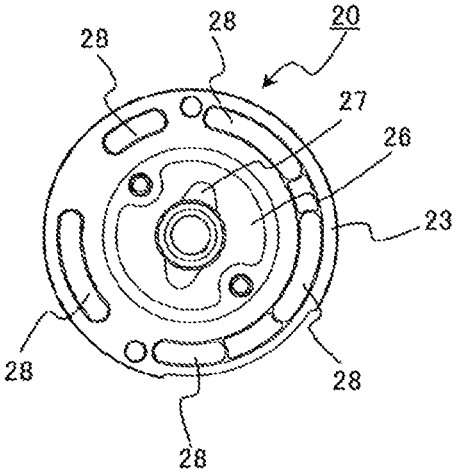
FIG. 2 is a top plan view of a compression mechanism as illustrated in FIG. 1.

FIG. 2 is a top plan view of the compression mechanism 20 as illustrated in FIG. 1. To an upper surface of the compression mechanism 20, a muffler member 26 is attached in such a manner as to cover the discharge opening portion 25. In an upper surface of the muffler member 26, an opening portion 27 is formed. The refrigerant is discharged through the discharge opening portion 25 into space defined by the muffler member 26 and the upper surface of the compression mechanism 20, and is then discharged into space in the shell 10 through the opening portion 27.

(Motor Unit 30)

The motor unit 30 includes a stator 31 and the rotor 32. The stator 31 has an outer circumferential surface fixed to an inner wall of the shell 10. The stator 31 includes a plurality of coils arranged circularly. The coils are formed by winding wires made of, for example, copper or aluminum, around an iron core. Between the coils and the iron core, an electrical insulating material is provided to reduce leak current. In the motor unit 30, current flows through the coils of the stator 31 to produce a magnetic field, thereby driving the rotor 32.

The rotor 32 is cylindrical, and to a central portion of the rotor 32, the main shaft 60 is attached. The rotor 32 is spaced from an inner circumferential surface of the stator 31 by a predetermined gap. The rotor 32 is driven and rotated by the magnetic field produced by the stator 31, thereby rotating the main shaft 60. The main shaft 60 transmits a driving force produced by the rotor 32 to the compression mechanism 20.

The rotor 32 has a rotor passage that causes spaces located above and below the motor unit 30 to communicate with each other. For example, the rotor passage is, for example, a hole that extends through the rotor 32 in a vertical direction. The refrigerant can move from the compression mechanism 20 toward the discharge port 15 through the rotor passage (Lower Insulating Member 40)

Since current flows through the coils of the stator 31, the compression mechanism 20 is spaced from the motor unit 30 by a predetermined distance to achieve insulation between the compression mechanism 20 and the motor unit 30. In Embodiment 1, a lower insulating member 40 is provided in the space between the motor unit 30 and the compression mechanism 20 located below the motor unit 30. The lower insulating member 40 is provided at a location outward of the inner circumferential surface of the stator 31. Also, the lower insulating member 40 is located in a region extending from a lower end face of the stator 31 to a position close to the upper surface of the compression mechanism 20. Furthermore, the lower insulating member 40 is, for example, cylindrical, and is provided in such a manner to reduce the space in a region between the motor unit 30 and the compression mechanism 20. The lower insulating member 40 is located close to an outer circumferential surface of the muffler member 26 attached to the upper surface of the compression mechanism 20 such that the lower insulating member 40 does not hinder the flow of the refrigerant discharged from the muffler member 26 through the opening portion 27 upward an upper region in the shell 10. It should be noted that the shape of the lower insulating member 40 is not limited to the cylindrical shape. The lower insulating member 40 may be provided in part of the region between the motor unit 30 and the compression mechanism 20. It is not indispensable that the lower insulating member 40 has a continuous cylindrical shape. For example, the lower insulating member 40 can be formed to have divided portions arranged cylindrically.

The lower insulating member 40 may have a width that is at least equal to a coil length of each of the coils of the stator 31 between an inner circumferential edge and an outer circumferential edge of the stator 31. Because of provision of such a configuration, a passage from each coil to a peripheral component has a greater length, thus preventing leak current.

The lower insulating member 40 may be formed integrally with the insulating material of the stator 31 of the motor unit 30, or may be fixed to the stator 31. The lower insulating member 40 can be fixed to the stator 31 by, for example, a fastener such as a screw, or by welding or bonding.

(Upper Insulating Member 50)

In Embodiment 1, an upper insulating member 50 is provided in a region above the motor unit 30. The upper insulating member 50 is located at a location outward of the inner circumferential surface of the stator 31. Furthermore, the upper insulating member 50 is located in a region above an upper end face of the stator 31, and is provided in such a manner to reduce the space above the motor unit 30 in the shell 10. The upper insulating member 50 may be cylindrically shaped, as well as the lower insulating member, or may be provided in part of the region above the stator 31. In Embodiment 1, an oil separator 64 is provided above the rotor 32. The upper insulating member 50 is separated from the oil separator 64 by a predetermined distance, and located outward of the oil separator 64.

(Flow of Refrigerant in Shell 10)

The flow of the refrigerant in the compressor 100 according to Embodiment 1 will be described with reference to FIG. 1. The refrigerant sucked through the suction port 14 is compressed by rotating the rolling piston 22 in the internal space of the cylinder 21 in the compression mechanism 20. The compressed refrigerant is discharged through the discharge opening portion 25 into the space defined by the muffler member 26 and the upper surface of the compression mechanism 20. Then, the refrigerant flows out of the muffler member 26 through the opening portion 27 provided in the upper surface of the muffler member, and enters the region between the compression mechanism 20 and the motor unit 30. The lower insulating member 40 is provided close to the outer circumferential surface of the muffler member 26, and the refrigerant thus does not easily flow toward the outer circumferential surface of the muffler member 26. The refrigerant mostly flows into a first passage which is a hole extending in the vertical direction, through the rotor 32 located above the muffler member 26.

The refrigerant that has flowed into the first passage flows upwards and strikes against the oil separator 64 located above the rotor 32 and attached to the main shaft 60. Then, the refrigerant flows upwards around the oil separator 64 and flows into the discharge port 15 provided in the upper part of the shell 10.

The refrigerant is in a gaseous state in the shell 10. When compressed in the compression mechanism 20, the refrigerant is discharged together with lubricating oil, from the compression mechanism 20. The lubricating oil moves together with the refrigerant that flows in the above manner, and the lubricating oil collects as it moves upwards, and then flows downwards in the shell 10 because of gravity. In such a manner, the lubricating oil flows downwards, and is thus separated from the refrigerant. The lubricating oil does not easily flow to the refrigeration cycle circuit.

In particular, since the shell 10 is formed to have a great length in the vertical direction, the lubricating oil can be easily separated from the refrigerant. In the compressor 100 according to Embodiment 1, a path from the compression mechanism 20 to the discharge port 15 is long. The lubricating oil can be easily separated from the refrigerant when the refrigerant is flowing. In FIG. 1, arrows indicate the flow of the refrigerant. The oil separator 64 is located on a path along which the refrigerant flows to reach the discharge port 15, and the refrigerant flows around the oil separator 64. As a result, the path along which the refrigerant flows is long, whereby the lubricating oil can be easily separated from the refrigerant.

In Embodiment 1, the lower insulating member 40 and the upper insulating member 50 are arranged along the path along which the refrigerant flows. Thus, the lubricating oil touches and adheres to the lower insulating member 40 and the upper insulating member 50, and can thus be easily separated from the refrigerant.

Furthermore, in the shell 10, a main passage in which refrigerant flows is located on inner circumferential sides of the lower insulating member 40, the stator 31, and the upper insulating member 50. Between the inner wall of the shell 10 and each of the lower insulating member 40, the stator 31, and the upper insulating member 50, passages are provided to cause an upper region located above the lower insulating member 40, the stator 31, and the upper insulating member 50 and a lower region located below the lower insulating member 40, the stator 31, and the upper insulating member 50 to communicate with each other. The lubricating oil separated from the refrigerant and adhering to the inner wall of the shell 10 passes through the above passage and reaches a lubricating oil sump 16 provided in the lower part of the shell 10. The passage provided between an outer circumferential surface of the lower insulating member 40 and the inner wall of the shell 10 will be referred to as a lower insulating-member passage 80. The passage provided between the outer circumferential surface of the stator 31 and the inner wall of the shell 10 will be referred to as a stator circumferential passage 81. The passage provided between an outer circumferential surface of the upper insulating member 50 and the inner wall of the shell 10 will be referred to as an upper insulating-member passage 82.

As illustrated in FIG. 1, each of the lower insulating member 40 and the upper insulating member 50 is spaced from the inner wall of the shell 10 by a gap. However, the lower insulating member 40 and the upper insulating member 50 may be provided in contact with the inner wall of the shell 10. In this case, in outer circumferential surfaces of the lower insulating-member passage 80 and the upper insulating-member passage 82, grooves are provided. The grooves and the inner wall of the shell 10 define the lower insulating-member passage 80 and the upper insulating-member passage 82.

In the compressor 100, the refrigerant compressed by the compression mechanism 20 passes through the passages indicated by the arrows in FIG. 1 and reaches the discharge port 15. Thus, the lubricating oil is separated from the refrigerant, and at the same time the refrigerant is discharged out of the compressor 100. The lower insulating member 40 and the upper insulating member 50 are arranged outside the inner circumferential surface of the stator 31, and thus reduce the volume of the shell 10 without hindering the flow of the refrigerant. In addition, on the outer circumferential side of the lower insulating member 40, the lower insulating-member passage 80 is provided, and on the outer circumferential side of the upper insulating member 50, the upper insulating-member passage 82 is provided, thereby providing passages through which the lubricating oil separated from the refrigerant and adhering to the inner wall of the shell 10 returns to the lubricating oil sump 16. The lower insulating-member passage 80 and the upper insulating-member passage 82 are separated from the main passage for the flow of the refrigerant by the lower insulating member 40 and the upper insulating member 50, thereby enabling the lubricating oil to efficiently return to the lubricating oil sump 16.

As illustrated in FIG. 2, an upper surface of the upper bearing 23 corresponds to an upper surface of the compression mechanism 20, and the upper bearing 23 has compression-mechanism passages 28 that extend through the compression mechanism 20. In Embodiment 1, the upper bearing 23 has an outer circumferential surface fixed to the inner wall of the shell 10. The circumference of each of the cylinder 21 and the lower bearing 24 is smaller than that of the upper bearing 23. In particular, the cylinder 21 and the lower bearing 24 each have an outer circumferential surface located inward of the compression-mechanism passages 28 arranged in the upper bearing 23. Thus, the compression-mechanism passages 28 cause regions above and below the compression mechanism 20 to communicate with each other.

The compression-mechanism passages 28 are arranged below the upper insulating-member passage 82, the stator circumferential passage 81, and the lower insulating-member passage 80. It is therefore possible to efficiently return the lubricating oil that flows from an upper region, to the lubricating oil sump 16.

Embodiment 2

In a compressor 200 according to Embodiment 2, the lower insulating member 40 of the compressor 100 according to Embodiment 1 is modified. Embodiment 2 will be described by referring mainly to the difference between Embodiments 1 and 2.

Figure 3:
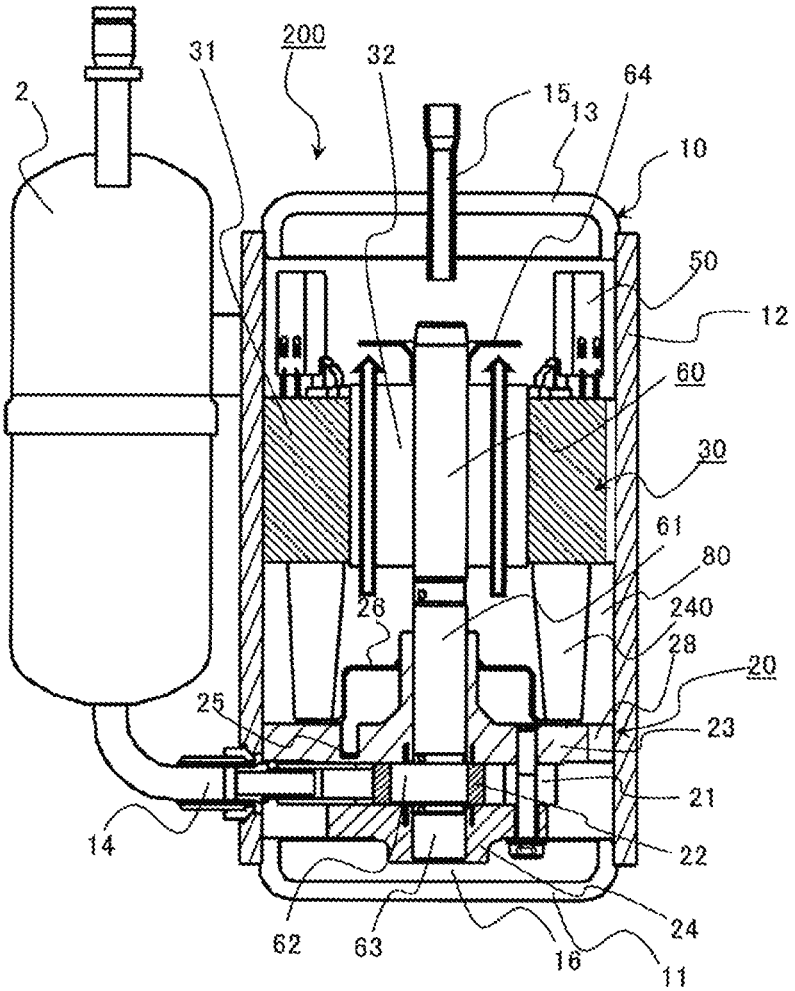
FIG. 3 is a schematic diagram illustrating a section of a compressor according to Embodiment 2.

FIG. 3 is a schematic diagram illustrating a section of the compressor 200 according to Embodiment 2. In the compressor 200, a lower insulating member 240 is provided in the region between the lower end face of the stator 31 and the upper surface of the compression mechanism 20. A lower end face of the lower insulating member 240 is in contact with the upper surface of the compression mechanism 20, that is, the upper surface of the upper bearing 23.

Since the lower insulating member 240 is in contact with the upper surface of the compression mechanism 20, the lower insulating member 240 can be easily positioned in the shell 10. For example, after the compression mechanism 20 is fixed to a shell cylindrical member 12, the lower insulating member 240 is inserted into the shell cylindrical member 12 and is brought into contact with the upper surface of the compression mechanism 20, whereby the lower insulating member 240 is positioned. After that, the stator 31 of the motor unit 30 is inserted into the shell cylindrical member 12, and is moved until the stator 31 is brought into contact with the lower insulating member 240, thereby positioning the compression mechanism 20, the lower insulating member 240, and the stator 31.

In the compression mechanism 20, the outer circumferential surface of the upper bearing 23 is fixed to the shell cylindrical member 12 by, for example, spot welding or caulking. The stator 31 is fixed to the shell cylindrical member 12 by, for example, shrink fitting, caulking, or spot welding.

In Embodiment 2, when the lower insulating member 240 is in contact with the stator 31 and the compression mechanism 20, the distance between the stator 31 and the compression mechanism 20 is determined. Thus, at the time of assembly, it is possible to set the stator 31 and the compression mechanism 20 without a jig, while accurately determining the distance between the stator 31 and the compression mechanism 20. Furthermore, a flow passage through which the refrigerant compressed by the compression mechanism 20 flows and a return passage through which the lubricating oil returns to the lubricating oil sump 16 are ensured as in Embodiment 1.

Figure 4:
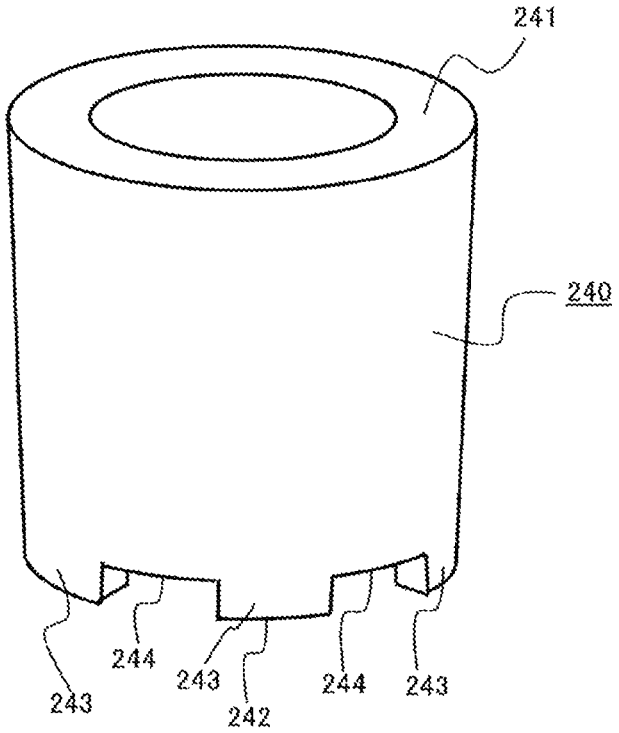
FIG. 4 is a perspective view of an example of a lower insulating member included in the compressor according to Embodiment 2.

FIG. 4 is a perspective view of an example of the lower insulating member 240 of the compressor 200 according to Embodiment 2. The lower insulating member 240 has a lower end face 242 or lower end faces 242. To be more specific, in the lower insulating member 240, a single lower end face 242 may be provided. Alternatively, a plurality of lower end faces 242 may be provided and arranged in a circumferential direction as illustrated in FIG. 4. In this case, the lower end faces 242 of the lower insulating member 240 do not close the compression-mechanism passages 28 provided in the compression mechanism 20. Thus, the passage in which the lubricating oil returns to the lubricating oil sump 16 is ensured. To be more specific, the lower insulating member 240 has recesses 244 in its lower portion such that the recesses 244 are arranged in such a manner as to correspond to the compression-mechanism passages 28, thereby ensuring the passage through the lubricating oil flows. In addition, since the lower end face or faces 242 of the lower insulating member 240 are brought into contact with the upper surface of the compression mechanism 20, an appropriate distance between the stator 31 and the compression mechanism 20 is ensured.

Referring to in FIG. 4, the lower insulating member 240 has a single flat upper end face 241. However, the shape of the upper end face 241 can be appropriately changed in order that the upper end face 241 be in contact with the stator 31. For example, upper end faces 241 may be provided as portions to be in contact with insulating portions of the stator 31. Furthermore, the upper end face 241 may be shaped in accordance with the shape of the stator 31.

Embodiment 3

In a compressor 300 according to Embodiment 3, a lower portion of the lower insulating member 40 of the compressor 100 according to Embodiment 1 is modified such that the lower portion also serves as the muffler member 26 of the compression mechanism 20. Embodiment 3 will be described by referring mainly to the difference between Embodiments 1 and 3.

Figure 5:
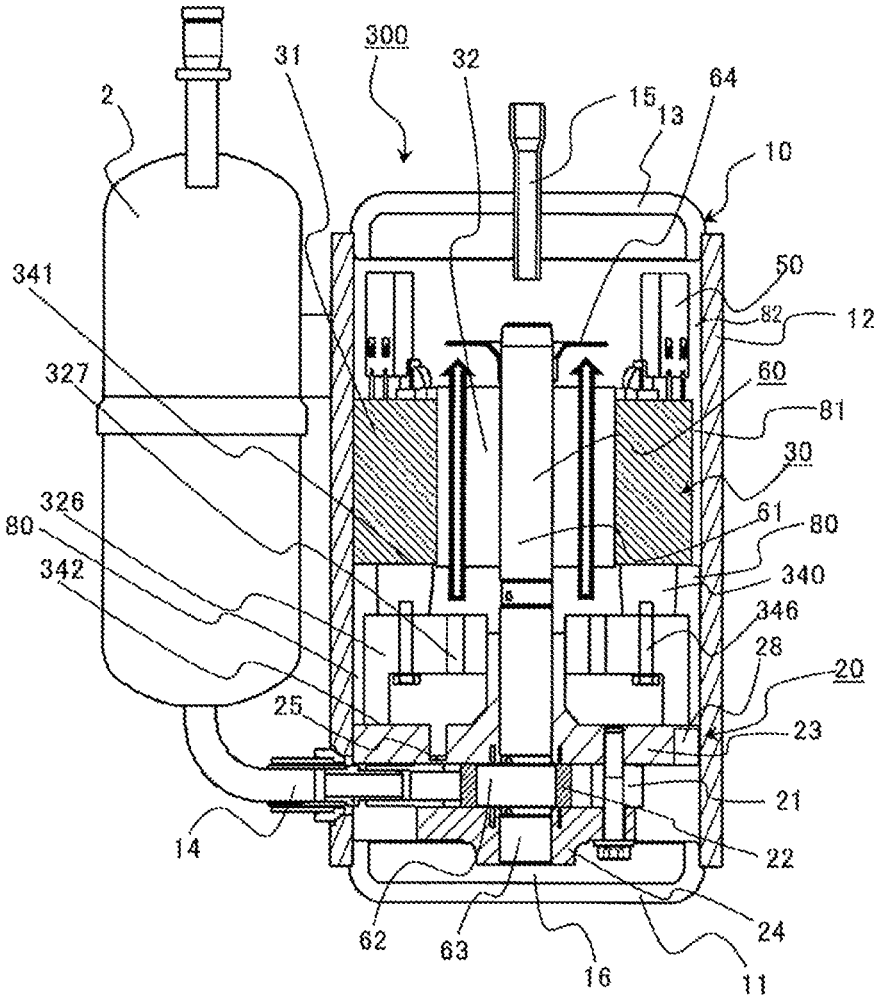
FIG. 5 is a schematic diagram illustrating a section of a compressor according to Embodiment 3.

FIG. 5 is a schematic diagram illustrating a section of the compressor 300 according to Embodiment 3. In Embodiment 3, a lower portion of a lower insulating member 340 serves as a muffler member 326. The muffler member 326 is shaped in such a manner as to cover the discharge opening portion 25 of the compression mechanism 20. The muffler member 326 has a lower end face 342 that is in contact with the upper surface of the compression mechanism 20. The muffler member 326 and the upper surface of the compression mechanism 20 define space into which the compressed refrigerant is discharged.

The muffler member 326 is made of a resin material. Preferably, the muffler member 326 should be made of an electrical insulating material. The muffler member 326 is, for example, a molded component made of a resin material. The muffler member 326 is shaped such that the muffler member 326 has a great thickness to have required rigidity and strength and to reduce the volume of the space between the motor unit 30 and the compression mechanism 20. Furthermore, the muffler member 326 is coupled to the lower insulating member 340 by coupling members 346 such as screws or bolts. That is, the muffler member 326 and the lower insulating member 340 are provided as a single component.

Since the lower insulating member 340 and the muffler member 326 are provided as a single component, the lower end face of the muffler member 326 is in contact with the upper surface of the compression mechanism 20 as in Embodiment 2. Because of such a configuration, the single component that is a combination of the lower insulating member 340 and the muffler member 326 serves as a positioning mechanism that accurately sets the compression mechanism 20 and the stator 31 such that the distance between the compression mechanism 20 and the stator 31 is set to a correct distance. For example, after the compression mechanism 20 is fixed to the shell cylindrical member 12, the single component that is the combination of the lower insulating member 340 and the muffler member 326 is inserted into the shell cylindrical member 12, and the muffler member 326 is brought into contact with the compression mechanism 20. Then, the stator 31 is brought into contact with an upper end face 341 of the lower insulating member 340 and is positioned at the shell cylindrical member 12. As a result, it is ensued that the distance between the stator 31 and the compression mechanism 20 is accurately determined without using a jig at the time of assembly.

In an upper surface of the muffler member 326, an opening 327 is formed. The refrigerant is discharged from the compression mechanism 20 through the discharge opening portion 25 into the space defined by the muffler member 326, and then flows into the opening 327. In Embodiment 3, since the lower insulating member 340 is located at a location outward of the inner circumferential surface of the stator 31, the refrigerant that has flowed out through the opening 327 flows toward the discharge port 15 without being obstructed by the lower insulating member 340.

In Embodiment 3, since the muffler member 326 combined with the lower insulating member 340 is made to have a great thickness, the muffler member 326 can reduce the volume of space located inward of the inner circumferential surface of the stator 31 in the region between the motor unit 30 and the compression mechanism 20. It is therefore possible to more greatly reduce the volume of the inside of the compressor 300 than in Embodiments 1 and 2, thus further reducing the amount of refrigerant provided in the refrigeration cycle circuit.

Embodiment 4

In a compressor 400 according to Embodiment 4, the upper insulating member 500 in the compressor 100 according to Embodiment 1 is modified to further have an oil separator function. Embodiment 4 will be described by referring mainly to the difference between Embodiments 1 and 4.

Figure 6:
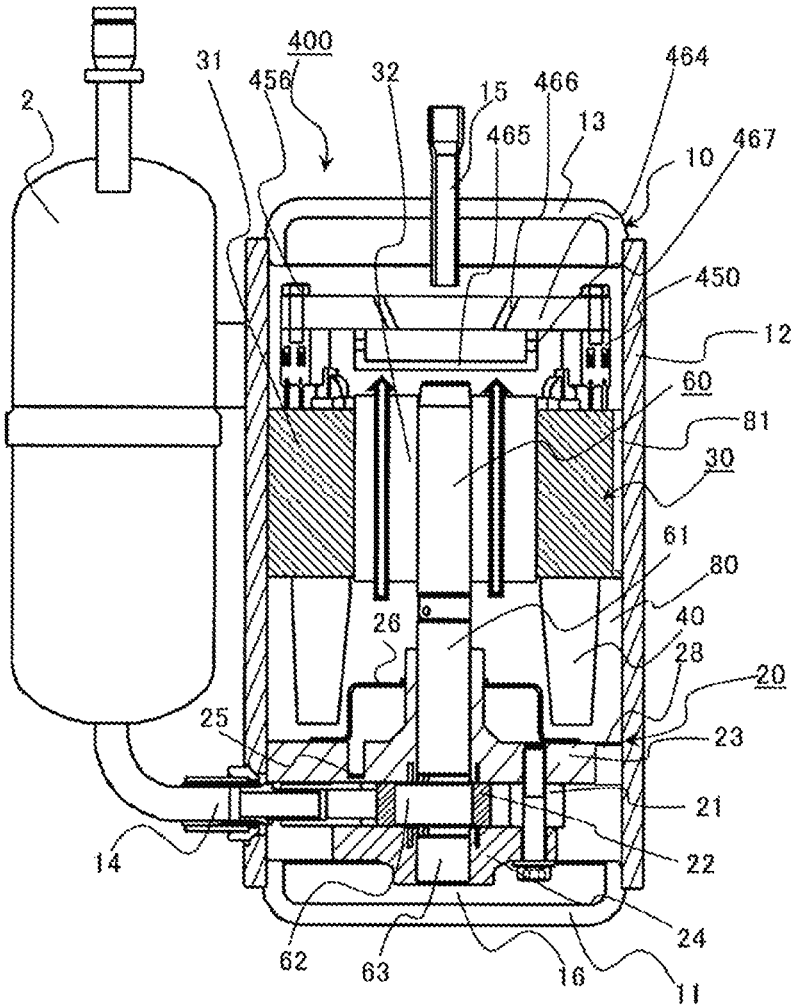
FIG. 6 is a schematic diagram illustrating a section of a compressor according to Embodiment 4.

FIG. 6 is a schematic diagram illustrating a section of the compressor 400 according to Embodiment 4. In Embodiment 4, an upper insulating member 450 and an oil separator member 464 are combined into a single component. The oil separator member 464 is shaped in such a manner as to cover the rotor 32. The refrigerant that have passed through the holes provided in the rotor 32 strikes against the oil separator member 464, passes through lubricating-oil separation holes 466 and 467 provided in the oil separator member 464, and flows to the discharge port 15. The oil separator member 464 includes a bypass structure 465. The oil separator member 464 and the bypass structure 465 are shaped in such a manner as to increase the length of a passage through which the refrigerant flows. Thus, when moving together with the refrigerant toward the upper part of the shell 10, the lubricating oil adheres to the oil separator member 464 and the bypass structure 465, and then flows downwards toward the lower part of the shell 10.

The oil separator member 464 is coupled to the upper insulating member 450 by coupling members 456 such as screws or bolts. The oil separator member 464 and the bypass structure 465 can be made of, for example, a resin material. The oil separator member 464 and the bypass structure 465 can be made to have a great thickness and can thus reduce the volume of the space above the motor unit 30. Furthermore, since the oil separator member 464 and the bypass structure 465 are provided in such a manner as to cover the upper side of the rotor 32, the oil separator member 464 and the bypass structure 465 can more greatly reduce the space above the motor unit 30 than the upper insulating member 50 in Embodiment 1. Therefore, in the compressor 400, it is possible to further reduce the amount of refrigerant provided in the refrigeration cycle circuit than in Embodiment 1.

The upper insulating member 450, the oil separator member 464, and the bypass structure 465 in the compressor 400 according to Embodiment 4 may be incorporated into each of the compressors 100, 200, and 300 according to Embodiments 1 to 3. In this case, it is possible to further reduce the volume of the shell 10, thus further reducing the amount of refrigerant provided in the refrigeration cycle circuit.

REFERENCE SIGNS LIST

2 accumulator 7 cylinder 10 shell 12 shell cylindrical member 14 suction port 15 discharge port 16 lubricating oil sump 20 compression mechanism 21 cylinder 22 rolling piston 23 upper bearing 24 lower bearing discharge opening portion 26 muffler member 27 opening portion 28 compression-mechanism passage 30 motor unit 31 stator 32 rotor 40 lower insulating member 50 upper insulating member 60 main shaft 61 main shaft 62 eccentric portion 64 oil separator 80 lower insulating-member passage 81 stator circumferential passage 82 upper insulating-member passage 100 compressor 200 compressor 240 lower insulating member 241 upper end face 242 lower end face 244 recess 300 compressor 326 muffler member 327 opening portion 340 lower insulating member 341 upper end face 342 lower end face 346 coupling member 400 compressor 450 upper insulating member 456 coupling member 464 oil separator member 465 bypass structure 466 lubricating-oil separation hole 467 lubricating-oil separation hole

The invention claimed is:

1. A compressor comprising:

a compression mechanism configured to compress refrigerant;

a motor unit provided above the compression mechanism, and configured to drive the compression mechanism;

a shell that houses the compression mechanism and the motor unit; and a lower insulating member provided between the compression mechanism and the motor unit, wherein the motor unit includes a stator fixed to the shell, and a rotor spaced from an inner circumferential surface of the stator by a predetermined gap, and wherein the lower insulating member is located in a region outward of the inner circumferential surface of the stator and in contact with an upper surface of the compression mechanism.

2. The compressor of claim 1, wherein the lower insulating member has an end face that is adjacent to the motor unit, and that has a width at least equal to a length of part of a coil included in the stator, the part of the coil extending between an inner circumferential edge and an outer circumferential edge of the stator.

3. The compressor of claim 1, wherein the lower insulating member is in contact with an inner wall of the shell.

4. The compressor of claim 3, wherein the lower insulating member has a lower insulating-member passage that is located between an outer circumferential surface of the lower insulating member and the inner circumferential surface of the shell, and that causes regions above and below the lower insulating member to communicate with each other.

5. The compressor of claim 1, wherein the lower insulating member includes lower portions arranged at intervals in a circumferential direction, wherein the compression mechanism has a compression-mechanism passage that causes regions above and below the compression mechanism to communicate with each other, and wherein the lower insulating member has a lower end face that is in contact with an entire body of the compression mechanism that excludes an opening of the compression-mechanism passage.

6. The compressor of claim 1, further comprising:

a muffler member that covers a discharge opening portion located in an upper surface of the compression mechanism, wherein the muffler member is located inward of an inner circumferential surface of the lower insulating member.

7. The compressor of claim 1, further comprising:

a muffler member that covers a discharge opening portion located in an upper surface of the compression mechanism, wherein the muffler member is made of an electrical insulating material, and is fixed to the lower insulating member.

8. The compressor of claim 7, wherein the muffler member has an inner circumferential surface that is in contact with a main shaft bearing that supports a main shaft coupled to the compression mechanism, and an outer circumferential surface that defines together with an inner circumferential surface of the shell, an opening that causes regions located above and below the muffler member to communicate with each other.

9. The compressor of claim 1, further comprising:

a cylindrical upper insulating member provided above the motor unit, wherein the upper insulating member is located in a region outward of the inner circumferential surface of the stator.

10. The compressor of claim 9, wherein the upper insulating member has an end face that is adjacent to the motor unit, and that has a width at least equal to a length of part of a coil included in the stator, the part of the coil extending between an inner circumferential edge and an outer circumferential edge of the stator.

11. The compressor of claim 9, wherein the upper insulating member has an upper insulating-member passage that is provided between an outer circumferential surface of the upper insulating member and the shell, and that causes regions located above and below the upper insulating member to communicate with each other.

12. The compressor of claim 9, further comprising:

an oil separator member that covers the stator, wherein the oil separator member is made of an electrical insulating material, has a lubricating-oil separation hole that causes regions above and below the oil separator member to communicate with each other, and is fixed to the upper insulating member.

13. The compressor of claim 1, wherein the refrigerant is any of R290, R600a, R32, R454B, R1234yf, and R1234ze.

14. The compressor of claim 1, wherein the rotator has a rotator passage that causes spaces located above the motor unit to communicate with each other.

15. A compressor comprising:

a compression mechanism configured to compress refrigerant;

a motor unit provided above the compression mechanism, and configured to drive the compression mechanism;

a shell that houses the compression mechanism and the motor unit; and an upper insulating member provided above the motor unit, wherein the motor unit includes a stator fixed to the shell, and a rotor spaced from an inner circumferential surface of the stator by a predetermined gap, the rotor having a rotor passage that causes spaces located above and below the motor unit to communicate with each other, and wherein the upper insulating member is located in a region outward of the inner circumferential surface of the stator and in contact with an inner wall of the shell, and between an outer circumferential surface of the upper insulating member and the inner wall of the shell, an upper insulating-member passage is provided to cause regions located above and below the upper insulating member to communicate with each other.

16. The compressor of claim 15, wherein the upper insulating member has an end face that is adjacent to the motor unit, and that has a width at least equal to a length of part of a coil included in the stator, the part of the coil extending between an inner circumferential edge and an outer circumferential edge of the stator.

17. The compressor of claim 15, further comprising:

an oil separator member that covers the stator, wherein the oil separator member is made of an electrical insulating material, has a lubricating-oil separation hole that causes regions located above and below the oil separator member to communicate with each other, and is fixed to the upper insulating member.

* * * * *